33-241 SR
10/9/79 XR 4,170,071

United States Patent [19]

Mann et al.

[11] 4,170,071

[45] Oct. 9, 1979

[54] SIGHTING APPARATUS

[76] Inventors: Jerry Mann, 7400 Africa Rd., Westerville, Ohio 43081; Theodore Schultz, 11360 Highland Park, Logan, Ohio 43138

[21] Appl. No.: 872,608

[22] Filed: Jan. 26, 1978

[51] Int. Cl.[2] ..... F41G 1/00

[52] U.S. Cl. ..... 33/265; 33/241; 124/87

[58] Field of Search ..... 33/265, 241; 124/87

[56] References Cited

U.S. PATENT DOCUMENTS

| | | | |
|---|---|---|---|
| 3,815,271 | 6/1974 | Lynn | 33/241 |
| 3,945,127 | 3/1976 | Spencer | 33/265 |
| 4,026,032 | 5/1977 | Smith | 33/265 |

*Primary Examiner*—Steven L. Stephan

[57] ABSTRACT

A sighting device for use with an archery bow for hunting or target purposes, utilizing light emitting diodes which are battery operated and the intensity of which may be varied manually. The light emitting diodes are mounted at the ends of sighting pins which may be adjusted both vertically and horizontally, to compensate for distance and windage. The light emitting diodes are shaped so as to protrude beyond the end of the sighting pins and thus under bright ambient light conditions function to gather and disperse said ambient light even though not electrically energized.

8 Claims, 3 Drawing Figures

SIGHTING APPARATUS

BACKGROUND OF THE INVENTION

In using a bow and arrow for hunting or target purposes, the archer must be able to adjust any sighting device utilized in conjunction with his bow to compensate for his distance from the target and also for windage. Windage relates to lateral adjustments to the sighting device made by the archer dependent upon the individual archer's shooting techniques and equipment.

The prior art is replete with attachments to bows which may be utilized by the target shooting or hunting archer to make such compensations, depending upon his individual shooting style.

Traditionally, the archer would enjoy being able to utilize his sighting device as long as he can discern his target. While this is of some importance in target practice, it becomes essential in hunting, which is often done at dusk or dawn or in heavily shaded wooded areas as well as in the bright sunlight. Ideally, the archer should have a point source incorporated in his sighting device which he can see under such varying lighting conditions which can be adjusted to compensate not only for his distance from the target and windage, but also which may be readily and quickly adjusted in the field for the third variable, variation in ambient lighting conditions.

SUMMARY OF THE INVENTION

The present invention relates to a sighting device which may be used when attached to an archery bow, which not only is readily manually adjustable to compensate for different target distances and windage, but also may be easily and quickly manually adjusted in the field for variations in ambient lighting conditions.

It is therefore an object of this invention to provide a sighting device, which may be attached to an archery bow, and which has a means for manual adjustment of the sighting pins to compensate for windage and variations in the distance of the target from the archer, and also has a self contained energy source and means for its instant manual adjustment in the field to compensate for variations in ambient lighting conditions.

It is a further object of this invention to provide a sighting device provided with an energy source and one or more light emitting diodes designed and arranged so that their intensity may be varied and so that they will gather and disperse ambient light when the energy source has been turned off.

Other objects of the invention that will be obvious are in part pointed out more fully hereinafter.

DESCRIPTION OF THE PREFERRED EMBODIMENT

Figure 1:
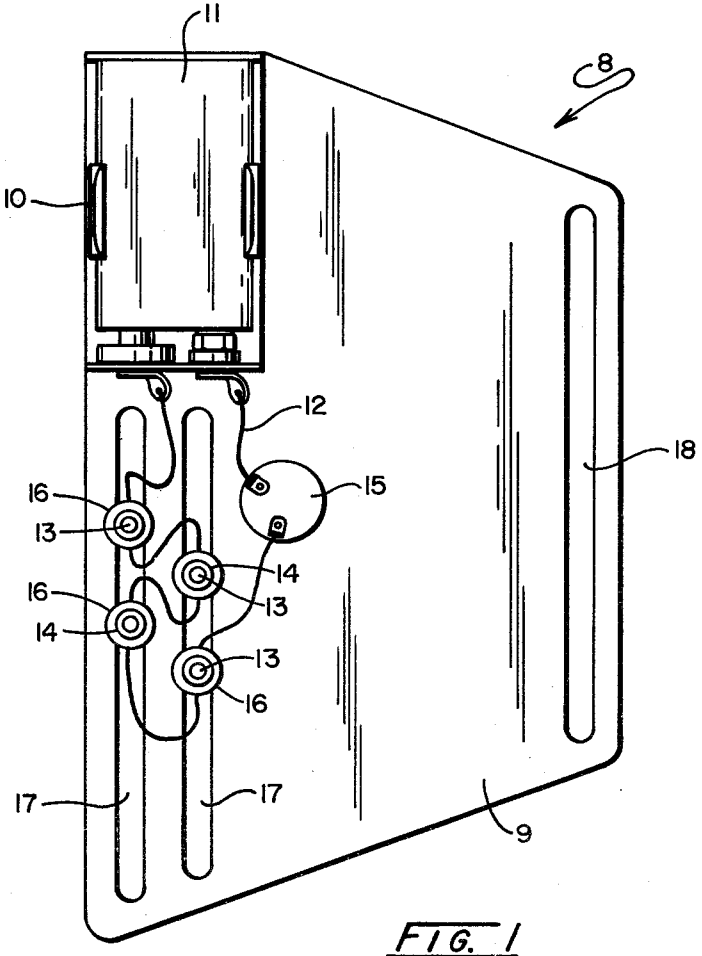
FIG. 1 is a front view of the sighting device.

Referring to FIG. 1, the sighting device shown generally at 8 is provided with a base plate 9 which has attached thereto by means of clamps 10 a source of energy 11 such as a battery. This source of energy 11 is connected through appropriate wires 12 to light emitting diodes 13 which are positioned in sighting pins 14. Of course the light emitting diodes 13 can all be of the same color or different colors or any combination of colors available, thus allowing a sighting device of a plurality of colors with each color representing different distances. While it is preferred that each sighting pin is equipped with a light emitting diodes 13, in some cases a combination of a plurality of pins and one or more light-emitting diodes may be used. The light emitting diodes are reconnected to the source of energy 11 through an on-off switch and variable resistance 15.

The sighting pins 14 are firmly held against the base plate 10 on one side by retainers 16 and positioned in slots 17. Slot 18 is provided for attachment of the sighting device to the bow.

Figure 2:
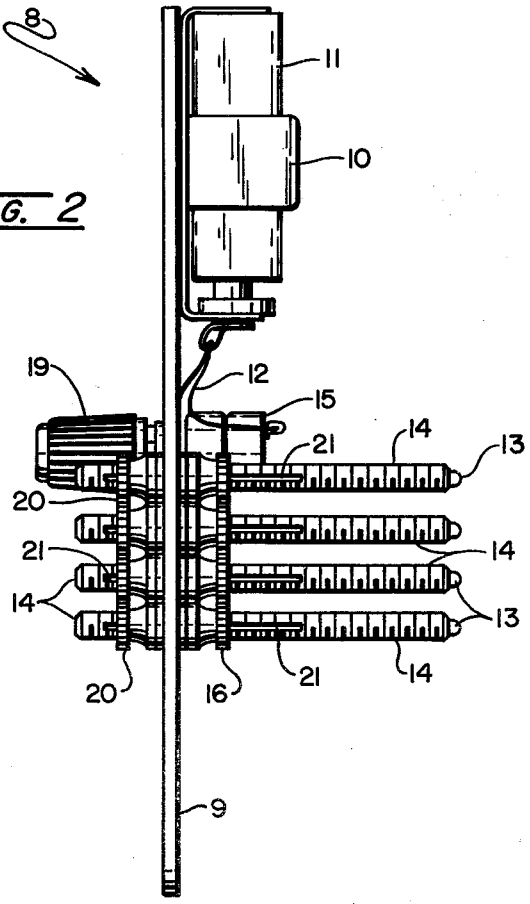
FIG. 2 is a side elevation view of the sighting device.

Referring now more particularly to FIG. 2, it will be observed that combination switch and variable resistance 15 is manually operated by knob 19. Of course, the on-off switch and variable resistance feature can be two separate units rather than one unit. Sighting pins 14 are firmly held against the opposite side of base plate 10 by retainers 20. It should also be noted that retainers 16 or retainers 20 or both of them may be knurled to facilitate manual adjustment of sighting pin 14.

The light emitting diodes 13 protrude from sighting pins 14 so as to enable diodes 13 to gather and disperse ambient light in bright lighting conditions when not electrically excited. Each sighting pin 14 is provided with a slotted portion 21 and each sighting pin 14 is hollow. This enables the wires 12 to be positioned in the hollow portion of the sighting pins 14 to connect with the light emitting diodes 13. This also enables the sighting pins 14 to be moved backward and forward and slid upward and downward in the slots 17, to compensate for target distance and lateral adjustments, thus keeping the wires 12 next to plate 9 and minimizing the possibility of the wires 12 in the sighting device 8 from catching on brush, twigs, etc. when used under hunting conditions.

Figure 3:
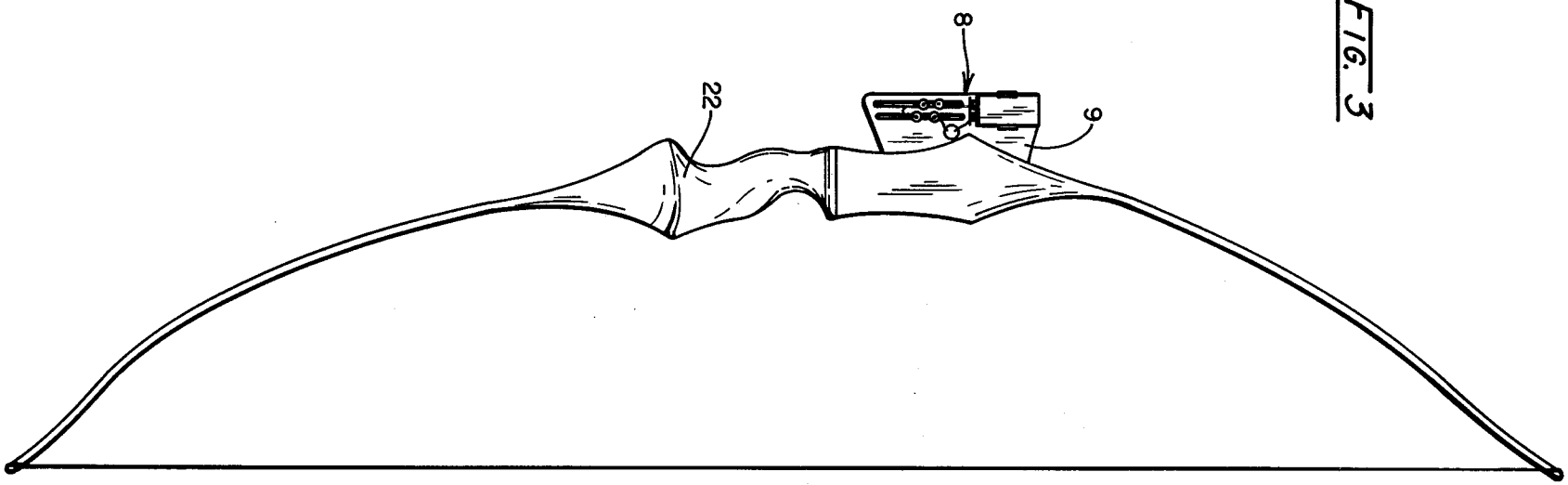
FIG. 3 is a side elevation view of a bow with the sighting device mounted thereon positioned to be used by an archer who would pull the bowstring with his right hand.

Referring now to FIG. 3, 22 is a conventional bow. The base plate 19 of the sighting device is attached to the bow 22 by means of slot 18 with appropriate material, such as bolts, screws or other mechanical means, depending upon the choice of the archer. Modern hunting bows are usually equipped with threaded holes to accept bolts or screws which would fit in slot 18. As shown, the sighting device is attached to the bow 22 for use by an archer who would retract the bowstring using his right hand. Of course, this sighting device can be used by a left handed archer as well by reversing the sighting pins 14. If desired, the source of energy 11 and the on-off switch and variable resistance 15 may be positioned on the opposite side of the base plate 10.

In utilizing the sighting device 8 after it had been properly attached to the bow, the archer would then vary both the vertical and lateral location of the pins 14 by loosening and then retightening the retainers 16 and 20. This allows the sighting pins 14 to be adjusted to suit the individual archer with the minimum amount of effort and thus he can sight each sighting pin 14 to whatever yardage he desires.

By grouping the sighting pins 14 in two columns, a convenient compact sighting combination for distances of 10, 20, 30 and 40 yards, respectively, is provided. These are practical distances for bow hunting. However the yardages can be any combination of distances the archer desires. Of course, more or less sighting pins 14 can be utilized than the four shown.

Once the sighting pins 14 have been set in vertical alignment to the satisfaction of the archer, lateral windage corrections may then be made. This is accomplished by loosening the retainers 16 and 20 and turning the threaded sighting pins 14 until the desired position is reached and then retightening the retainers 16 and 20. The intensity of the light in the sighting point at the end of the sighting pins 14 as identified by the light emitting diodes 13 can be instantly varied in the field by adjustment of the knob 19. Under bright ambient lighting conditions it may be preferred to have the knob 19 turned to full-off position and merely rely on the light gathering properties of the protruding, light emitting diodes 13 to provide sufficient light for use in lining up the target. At dusk, dawn or in deep wooded conditions, the intensity of light in the light emitting diodes 13 may be varied by adjusting knob 19 to provide just enough light so that the sighting pin can be seen and used to line up the target but not so much light that it interferes with sighting on the target.

As the invention lends itself to many possible embodiments and as many possible changes may be made in this embodiment hereinbefore set forth, it will be distinctly understood that all matter described herein is to be interpreted as illustrative and not as a limitation.

What is claimed is:

1. A sighting device for use in combination with an archery bow, comprising:

a. a base plate, b. a source of energy mounted on said base plate, c. means for varying the amount of energy from said energy obtained from said energy source, said means being manually operable, d. manually operable switch means electrically connecting said source of energy to said means for varying the amount of energy obtained from said source of energy, e. at least one light emitting diode electrically connected to said means for varying the amount of energy available from said source of energy and also electrically connected to said source of energy, f. at least one sighting pin mounted on said base plate, said at least one light emitting diode being mounted in and protruding beyond the end of said at least one sighting pin and circumferentially exposed to ambient light.

g. means for vertically and horizontally manually adjusting said at least one sighting pin, and h. means for mounting said sighting device on an archery bow.

2. The device of claim 1 wherein said source of energy is a battery.

3. The device of claim 1 wherein said means for varying the amount of energy available from said energy source is a variable resistance.

4. The device of claim 1 wherein said sighting pin in which said at least one light emitting diode is mounted is hollow and externally threaded.

5. The device of claim 3 wherein said switch means and said variable resistance are combined as a single component.

6. The device of claim 4 wherein said pin is slotted in that portion of its length wherein it is mounted on said sighting device.

7. The device of claim 4 wherein said base plate is provided with at least one slot to receive said pin.

8. The device of claim 7 wherein said pin is provided with a manually adjustable retainer adapted to position said pin in said slot.

* * * * *